US009838781B2

(12) United States Patent
Behles et al.

(10) Patent No.: US 9,838,781 B2
(45) Date of Patent: Dec. 5, 2017

(54) APPARATUS AND METHOD FOR REDUCING SOUND COUPLING

(71) Applicant: Nokia Corporation, Espoo (FI)

(72) Inventors: Thorsten Behles, Kangasala (FI); Pasi Tuomo Antero Kemppinen, Tampere (FI); Mikko Tapio Jyrkinen, Tampere (FI); Marko Tapani Yliaho, Tampere (FI)

(73) Assignee: Nokia Technologies Oy, Espoo (FI)

( * ) Notice: Subject to any disclaimer, the term of this patent is extended or adjusted under 35 U.S.C. 154(b) by 259 days.

(21) Appl. No.: 14/287,597

(22) Filed: May 27, 2014

(65) Prior Publication Data

US 2015/0350775 A1 Dec. 3, 2015

(51) Int. Cl.
*H04R 3/00* (2006.01)

(52) U.S. Cl.
CPC ..... *H04R 3/002* (2013.01); *H04R 2499/11* (2013.01); *H04R 2499/15* (2013.01)

(58) Field of Classification Search
CPC H04R 2499/11; H04R 7/045; H04R 2400/03; H04R 17/00; H04R 1/2807; H04R 2440/05
See application file for complete search history.

(56) References Cited

U.S. PATENT DOCUMENTS

| | | | | |
|---|---|---|---|---|
| 7,151,837 | B2 | 12/2006 | Bank et al. | |
| 2001/0017924 | A1 | 8/2001 | Azima et al. | 381/165 |
| 2001/0028716 | A1 | 10/2001 | Hill et al. | 381/58 |
| 2002/0118847 | A1 | 8/2002 | Kam | 381/111 |
| 2005/0025330 | A1 | 2/2005 | Saiki et al. | |
| 2006/0140437 | A1 | 6/2006 | Watanabe et al. | |
| 2006/0181522 | A1 | 8/2006 | Nishimura et al. | 345/177 |
| 2012/0149437 | A1 | 6/2012 | Zurek et al. | |
| 2015/0018046 | A1* | 1/2015 | Nabata | H04M 1/03 455/566 |

FOREIGN PATENT DOCUMENTS

| | | | |
|---|---|---|---|
| WO | WO-2012/025783 | A1 | 3/2012 |
| WO | WO-2012/052803 | A1 | 4/2012 |
| WO | WO-2012090031 | A1 | 7/2012 |
| WO | WO-2012/111348 | A1 | 8/2012 |

* cited by examiner

*Primary Examiner* — Matthew Eason
(74) *Attorney, Agent, or Firm* — Harrington & Smith

(57) ABSTRACT

An apparatus including a microphone; a speaker including at least one vibrating element and at least one movable section, where the at least one vibrating element is configured to at least partially move the at least one movable section to generate sound waves from the at least one movable section; and at least one vibration dampening member between the microphone and the at least one movable section, where the at least one vibration dampening member is suitably positioned in a path of vibration transmission between the at least one vibrating element and the microphone, where the at least one vibration dampening member is configured to absorb vibrations when the movable section is actuated by the at least one vibrating element.

26 Claims, 15 Drawing Sheets

APPARATUS AND METHOD FOR REDUCING SOUND COUPLING

BACKGROUND

Technical Field

The exemplary and non-limiting embodiments relate generally to a display panel speaker.

Brief Description of Prior Developments

Panel displays are becoming more prevalent in devices such as smart phones. Generating sound from a panel display is being investigated. The following abbreviations that may be found in the specification and/or the drawing figures are defined as follows:

AEC—Acoustic Echo Controller

TX ALWE—Background noise suppressor

UDRC—Uplink dynamic range controller

AFIR—Adaptive filter

SND(1)—sending side

UL DT Att—Uplink double talk attenuation

SUMMARY

The following summary is merely intended to be exemplary. The summary is not intended to limit the scope of the claims.

In accordance with one aspect, an example embodiment is provided in an apparatus comprising a microphone; a speaker comprising at least one vibrating element and at least one movable section, where the at least one vibrating element is configured to at least partially move the at least one movable section to generate sound waves from the at least one movable section; and at least one vibration dampening member between the microphone and the at least one movable section, where the at least one vibration dampening member is suitably positioned in a path of vibration transmission between the at least one vibrating element and the microphone, where the at least one vibration dampening member is configured to absorb vibrations when the movable section is actuated by the at least one vibrating element.

In accordance with another aspect, an example method comprises providing a speaker, where the speaker comprises at least one vibrating element and at least one movable section, where the at least one vibrating element is configured to at least partially move the at least one movable section to generate sound waves from the at least one movable section; and locating at least one vibration dampening member between a microphone and the at least one movable section, where the at least one vibration dampening member is suitably positioned in a path of vibration transmission a between the at least one vibrating element and the microphone, where the at least one vibration dampening member is configured to absorb vibrations when the movable section is actuated by the at least one vibrating element.

In accordance with another aspect, an example embodiment is provided in an apparatus comprising a microphone; a speaker comprising at least one vibrating element and at least one movable section, where the at least one vibrating element is configured to at least partially move the at least one movable section to generate sound waves from the at least one movable section; and at least one vibration dampening member connected against the at least one movable section, where the at least one vibration dampening member is suitably positioned in a path of vibration transmission between the at least one vibrating element and the microphone, where the at least one vibration dampening member is configured to absorb vibrations when the movable section is actuated by the at least one vibrating element.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
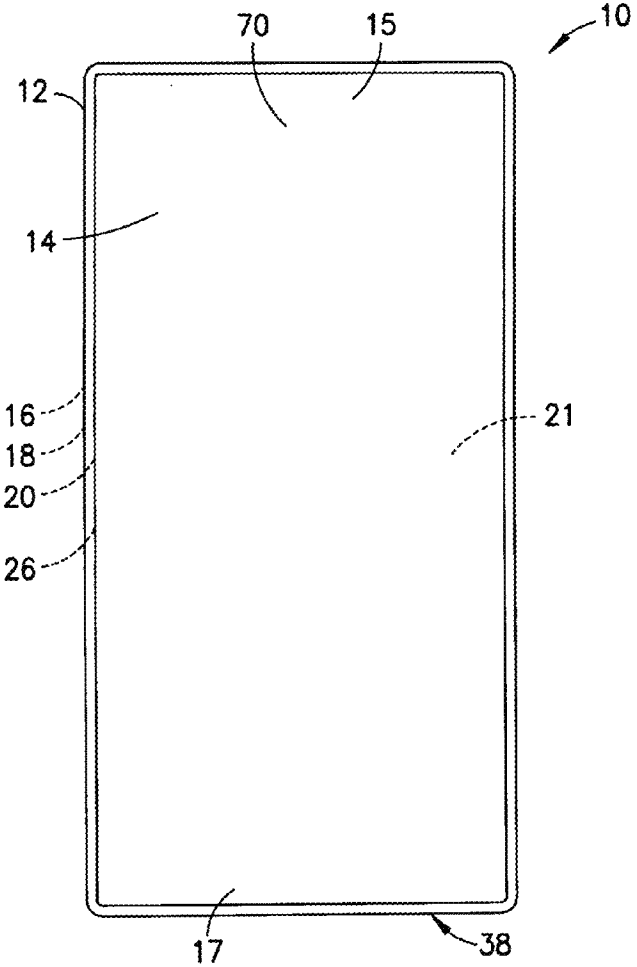
FIG. 1 is a front view of an example embodiment of an apparatus comprising features as described herein.

Referring to FIG. 1, there is shown a front view of an apparatus 10 incorporating features of an example embodiment. Although the features will be described with reference to the example embodiments shown in the drawings, it should be understood that features can be embodied in many alternate forms of embodiments. In addition, any suitable size, shape or type of elements or materials could be used.

The apparatus 10 may be a hand-held portable apparatus, such as a communications device which includes a telephone application for example. In the example shown the apparatus 10 is a smartphone which includes a camera and a camera application. The apparatus 10 may additionally or alternatively comprise an Internet browser application, a video recorder application, a music player and recorder application, an email application, a navigation application, a gaming application, and/or any other suitable electronic device application. In an alternate example embodiment the apparatus might not be a smartphone. The apparatus might be a gaming device or handset, or video recorder for example.

Figure 2:
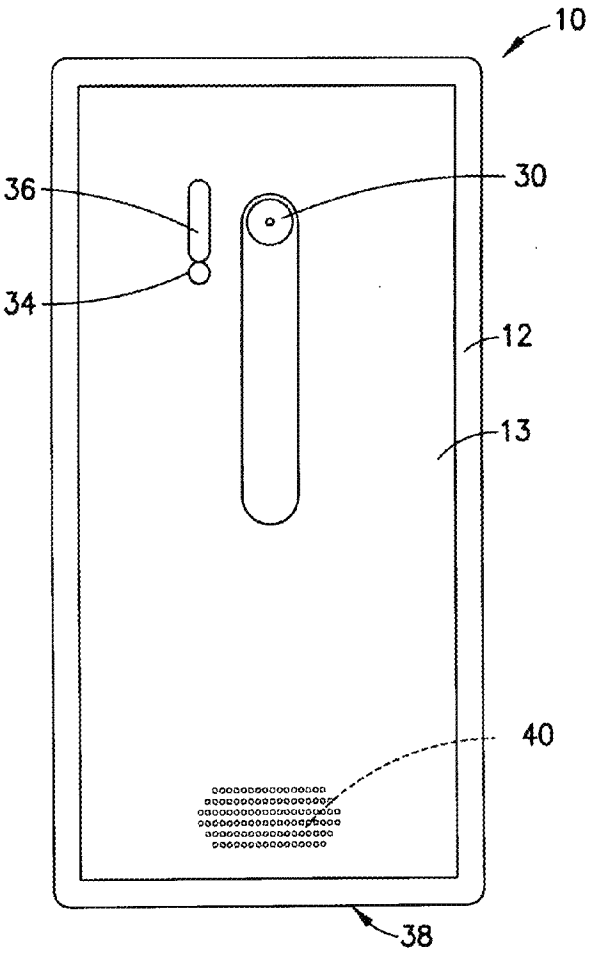
FIG. 2 is a rear view of the apparatus shown in FIG. 1.
Figure 3:
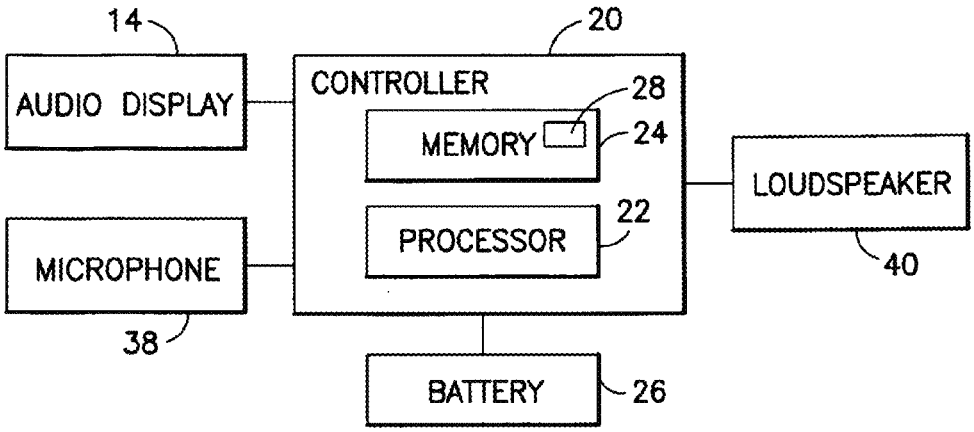
FIG. 3 is a diagram illustrating some of the components of the apparatus shown in FIGS. 1-2.

Referring also to FIGS. 2-3, the apparatus 10, in this example embodiment, comprises a housing 12, a display module 14 which includes a touchscreen function, a receiver 16, a transmitter 18, a controller 20, a rechargeable battery 26 and a camera 30. However, all of these features are not necessary to implement the features described below. The receiver and the transmitter may be provided in the form of a transceiver for example. The electronic circuitry inside the housing 12 may comprise at least one printed wiring board (PWB) 21 having components such as the controller 20 thereon. The controller 20 may include at least one processor 22, at least one memory 24, and software 28. The receiver 16 and transmitter 18 form a primary communications system to allow the apparatus 10 to communicate with a wireless telephone system, such as a mobile telephone base station for example.

In this example, the rear side 13 of the apparatus 10 includes the camera 30, an LED 34, and a flash system 36. The LED 34 and the flash system 36 are provided for the camera 30. The camera 30, the LED 34 and the flash system 36 are connected to the controller 20 such that the controller 20 may control their operation. In an alternate example embodiment the rear side may comprise more than one camera, and/or the front side could comprise more than one camera. The apparatus 10 includes a sound transducer provided as a microphone 38 and a sound transducer provided as a loudspeaker 40. In an alternate example the apparatus may comprise more than one microphone and/or more than one loudspeaker.

Figure 4:
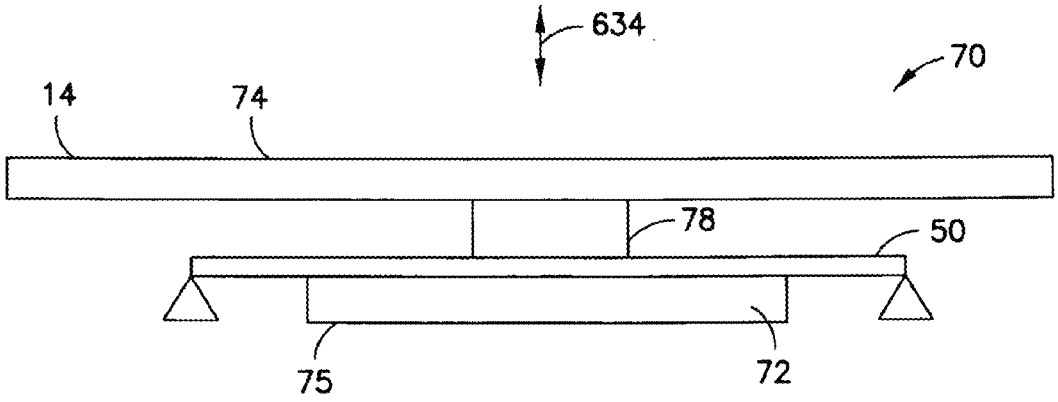
FIG. 4 is a schematic sectional view of the audio display module shown in FIG. 1.

Referring also to FIG. 4, the display module 14, in addition to the touchscreen function, forms an earpiece speaker 70 comprising a vibrating element 72 and an electronic display element 74. The electronic display element 74, in this example, functions as both a display screen and as a user input. The electronic display element 74 may comprise a touch input device (TID) as the display module 14, such as a capacitive sensor for example. However, features described herein may be used in a display which does not have a touch, user input feature. Alternatively, another example may comprise an apparatus which has a touchpad or touch-panel which is not part of an electronic display screen. FIG. 4 illustrates the use of a connecting pad (such as Firm foam for example) 78, a metal plate 50, a Uni-morph piezo as the vibrating element 72 and the connection of the piezo onto the frame via the metal plate. The uni-morph (piezo bender) may be used to push the front glass or for the whole display module 14. In the bender type assembly the front glass or display package will do a pistonic movement.

In this example the vibrating element 72 comprises a piezoelectric member 75. The piezoelectric member 75 may be electrically connected to the printed circuit board 21. The electronic display element 74 is an electronic display. A member 78 connects the piezoelectric member 75 to the back side of the electronic display element 74. In one example embodiment the piezoelectric member 75 is controllably flexed or vibrated by electricity supplied from the printed circuit board 21. This causes the piezoelectric member 75 to move the electronic display 74 in and out as illustrated by arrow 634 to generate sound waves from the front of the electronic display 74 (and/or the covering window).

In this example the apparatus comprises only one piezoelectric member 75 connected to the back side of the electronic display element 74 at the top end 15 of the display 14. The piezoelectric member 75 is spaced from the bottom end 17 of the display 14. The piezo actuator may be directly coupled to the display module or might not be directly coupled to the display module. The earpiece speaker in a broader definition may comprise additional element(s). For example, an earpiece speaker may have a plate under the display module where the piezo may be used to actuate the plate so that the plate could move/vibrate the display in a z-direction (634). The piezo or electromagnetic actuator (EMA) may be placed under the electronic display or directly under the front window. Both types of embodiments work well depending on the display technology. In an embodiment where the display is a LCD display, it is better if the piezo or EMA is connected to the front glass window. However, in an embodiment where the display is an OLED display, it may be better to place the actuator directly under the display, such as in the upper half or third of the display for example. For when the display is an OLED display, the low frequency output may be better if the actuator is placed there. This is because the display package is less stiff in this area, going closer to the center point of the display than at the edge of the display. The display can flex better when the actuator pushes at this area. Therefore, the low frequency output may be better. If the actuator is closer to the upper edge of the device it may be hard for the actuator to bend the display, but this may still be appropriate for when the display is an LCD display. When the display is an LCD display, the overall stiffness of the whole display package may be lower than when an OLED is laminated together with a glass window. That is why, when the display is an LCD display, the actuator can be added close to the edge and it still provides good low frequency output. If this were done when the display is an OLED display, the low frequency output might be quite low. When the display is an OLED display the actuator may be placed closest to the center of the device. A front window 80 may be provided as the front face of the electronic display element 74. In an alternate example embodiment, rather than a piezoelectric member, the vibrating element may comprise vibrating of the display with a dynamic actuator such as speaker or vibra. Thus, features as described herein are not limited to using a piezoelectric actuator.

Features as described herein may fundamentally utilize implementation of an "Audio Display" or "panel speaker" concept which has been developed by Nokia Corporation. In the Audio Display concept, generally, at least one piezo actuator may be suitably coupled to the display module for sound generation so that the display module can be used as a conventional display, but further for sound generation and perhaps tactile feedback. In alternative embodiments of Audio Display integrations, the piezo actuator may be coupled to the display window 80 (at the front of the display module 14) for sound generation. There are various ways of reproducing sound waves in the direction of the display module. The audio display module 14 is configured to function as a display and also function as a speaker or sound transducer.

As seen in FIG. 3, the audio display 14 is connected to the controller 20. The controller 20 is configured to control display of images on the electronic display element 74, and also control generation of sound from the audio display module 14. The source of the images and sounds may comprise any suitable source(s), such as applications, video, data from the Internet, television signals, etc. The audio signals sent to the audio display module 14 may be formed or controlled by the controller. The audio signals may be telephone voice signals from a telephone conversation. In this example the audio display module 14 is configured to provide an electronic display feature, an audio speaker feature and a haptic feedback feature. However, the haptic feedback feature might not be provided in an alternate embodiment.

Figure 5:
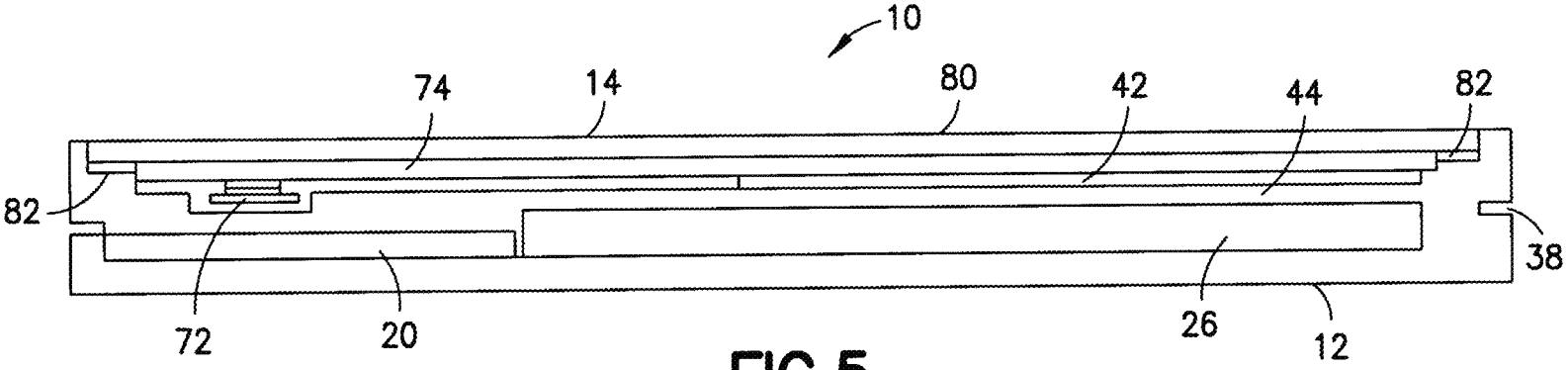
FIG. 5 is a schematic cross section view of the apparatus shown in FIGS. 1-2.
Figure 7:
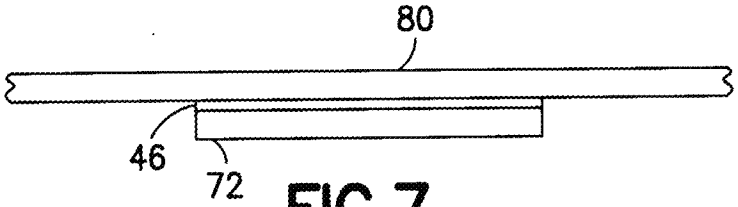
FIG. 7 is a schematic side view illustrating one type of connection of the vibrating element.
Figure 6:
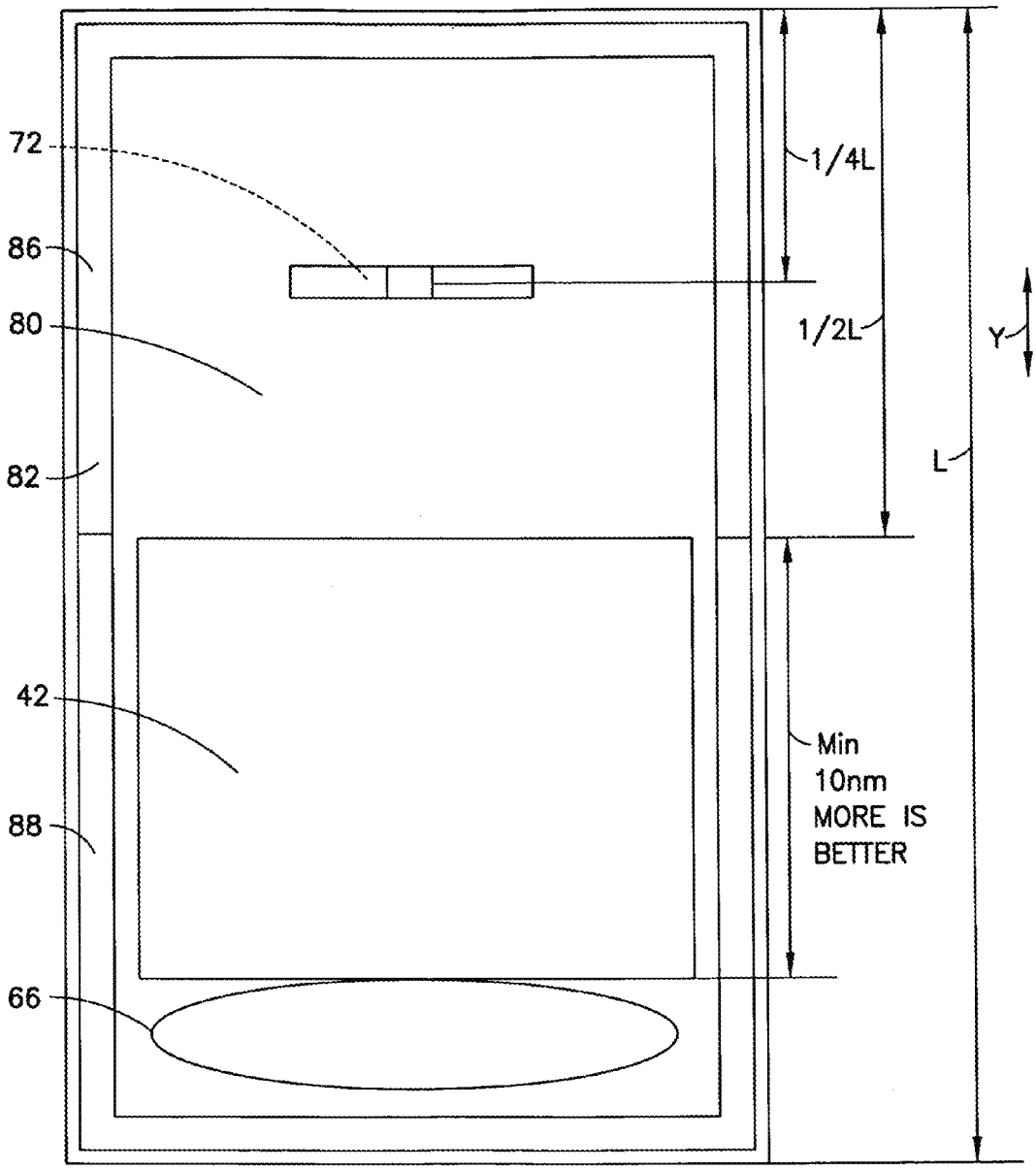
FIG. 6 is a schematic front view of the apparatus shown in FIG. 1 illustrating location of some of the components.

Referring also to FIGS. 5-6, in this example embodiment the display module 14 comprises the electronic display element 74 and the front window 80 as another display element. The sound hole for the main microphone is through the housing. However, in an alternate example a sound hole for the main microphone 38 may be through the front window 80. Referring also to FIG. 7, another example connection of the vibrating element 72 to a display element is shown. FIG. 7 illustrates the use of glue or adhesive 46 with a Bi-morph piezo ceramic as the vibrating element 72. The bi-morph piezo may be attached onto the front glass window for example and will try to bend or vibrate the front glass. As described below, a dampening tape/foam may placed under the lower half of the display to reduce vibrations and therefore acoustic coupling with the microphone.

Referring back to FIGS. 5-6, the front side of the electronic display element 74 is fixedly attached to the rear side of the front window 80. The display module 14 is attached to the housing 12 by a connection comprising the suspension 82. The connection by means of the suspension 82 provides a less visible connection of the display module 14 to the frame 12. The electronic display module 74 is suspension mounted to the frame 12 via the front window 80 and the suspension 82. However, the suspension 82 could be provided directly between the housing 12 and the electronic display element 74. The suspension 82 may comprise, for example, urethane foam such as PORON. Thickness of the soft suspension may be, for example, 0.3 mm, and there could be adhesive on both sides for fixing. Alternative materials are, for example, elastomers, TPE, TPU, silicone or rubber. The suspension might comprise Pressure Sensitive Adhesive tape, liquid glue or hot melt glue, for example. The apparatus 10 also comprises a vibration dampener 42. The suspension 82 may be uniform. However, in this example the suspension 82 comprises a first section 86 and a second section 88. The first section 86 is soft relative to the second section 88; yielding more readily to pressure. The second section 88 is hard relative to the first section 86; yielding less readily to pressure. The soft/hard difference between the two sections 86, 88 may be provided by the material characteristic of the suspension at the first section 86 versus the material characteristic of the suspension at the second section 88. For example, the material at the first section 86 may be more resilient that the material at the second section 88. The cross sectional shape of the first section 86 may alternatively or additionally be more resilient than the cross sectional shape of the second section 88. The topmost part 86 of the suspension 82 is soft and the other part 88 of the suspension is harder. The connection may comprise a connection similar to that described in U.S. patent application Ser. No. 14/151,328 which is hereby incorporated by reference in its entirety. In this example an area 66 is provided as a free space for the display integrated circuit (IC) and the touch integrated circuit (IC). The larger the size of the tape in Y-axis (see FIG. 6) the better the vibration removal before it reaches the microphone. In this example, as the tape gets bigger towards the microphone, starting from almost the mid line, then a better performance is achieved.

The vibration dampener 42 may comprise, for example, as pressure sensitive adhesive (PSA) tape or firm foam (such as Poron for example). Pressure-sensitive tape, known also in various countries as PSA tape, adhesive tape, self-stick tape, sticky tape, or just tape, is an adhesive tape that will stick with application pressure, without the need for solvent, heat, or water for activation. The tape consists of a pressure-sensitive adhesive coated onto a backing material such as paper, plastic film, cloth, or metal foil. Single-sided tapes allow bonding to a surface or joining of two adjacent or overlapping materials. Double-sided tape (adhesive on both sides) allows joining of two items back-to-back.

The vibration dampener 42 is provided between a portion 44 of the frame 12 and the rear side of the display element 74. The vibration dampener 42 is provided to help with echo cancellation as further described below. The vibration dampener 42 may be fixedly attached to the rear side of the electronic display 74 and/or to the front side of the portion 44. More than one vibration dampener may be provided. The vibration dampener 42 will help to improve the low frequency output and reduce coupling of the main microphone 38 with the panel speaker 70. In one example embodiment the tape works best if the portion or chassis 44 if the material of the portion 44 is metal, such as aluminum for example. The stiffer the chassis material, the better the tape 42 will work. This might not work as well for a plastic chassis; made out of PC ABS for example. It might work for glass fiber reinforces material, but the stiffer portion 44 the better.

In this example the vibration dampener 42 is PSA tape attached to the rear side of the display element 74. In an alternate example the vibration dampener 42 may be attached to the portion 44 by the adhesive or both the portion 44 and the rear side of the display element 74 such as with double sided PSA tape for example. The vibration dampener 42 has a general square or rectangular shape. However, any suitable shape could be provide. In addition, more than one vibration dampener could be provided in this area which are perhaps stacked relative to one another, interleaved relative to one another and/or located side-by-side relative to one another. In OLED based devices thin foam tapes are usually behind or on the back side of the OLED to help the OLED to survive a drop. But those are usually not touching or in compression with the chassis part. In this case the tapes may be stacked and the echo tape would be under compression so that it attenuates the vibrations. The upper part with the other OLED tape would be not in contact in an ideal case or with very little to no contact. In this example the vibration dampener 42 is located at the lower half of the display element 74. In this example the vibration dampening element 42 extends across a majority of a width of the display element 74 for about 90 percent or more of the lower half of the at least one vibration dampening member, but could be as little as 10 percent or more of the lower half of the display element. The vibration dampening member 42 is located against a majority of the lower half of the at least one display element at the rear side of the at least one display element. The vibration dampening member is attached to the rear side of the at least one display element by adhesive. The vibration dampening member does not extend substantially past the lower half of the display element onto a top half of the at least one display element.

Figure 8:
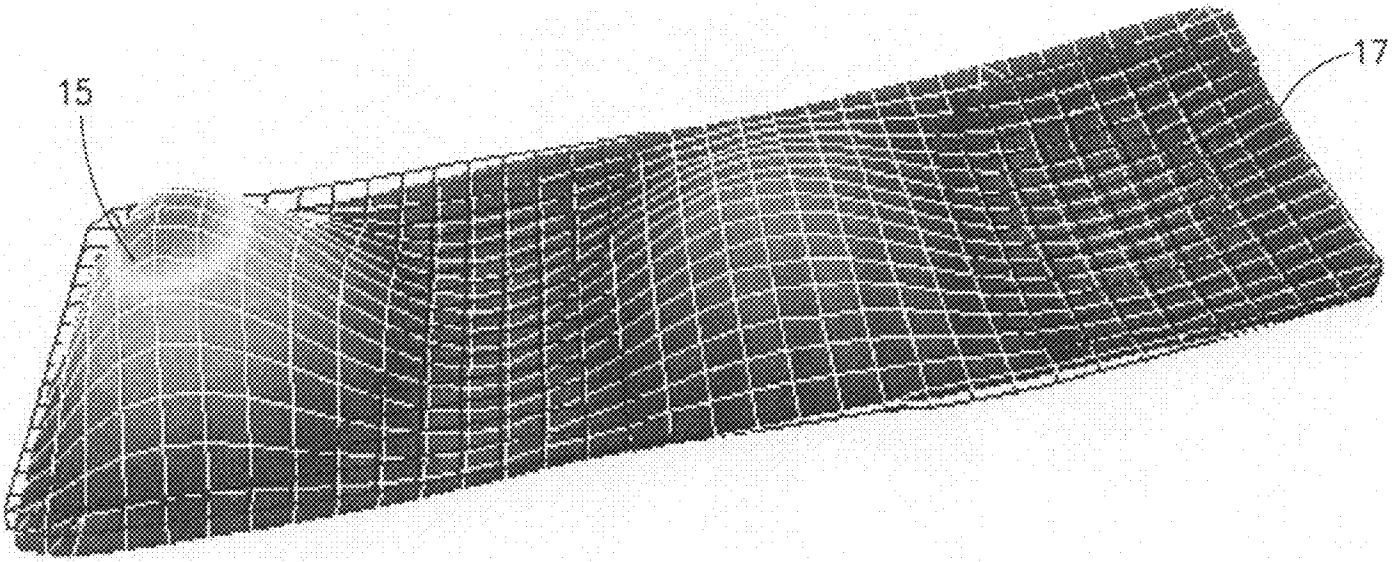
FIG. 8 is a diagram illustrating a laser vibrometer scan at 1 kHz of an apparatus without a vibration dampener.

Referring also to FIG. 8, an example of a laser vibrometer scan at 1 kHz of the apparatus 10 without the vibration dampener 42 is shown. The measured device has a soft suspension 82 connecting the display front glass with the device body. At the top end 15 of the display, where the vibrating element 72 is located, there is big excitation. At the lower end 17 of the display, near the main microphone 38, the excitation is less. However, the excitation may cause echo problems at the main microphone 38 from sound being generated at the earpiece section 70. With the help of the echo cancellation vibration dampener 42, the vibrations in the lower half of the display can be minimized so that the vibrating panel speaker 70 does not significantly couple acoustically to the main microphone 38.

Figure 9:
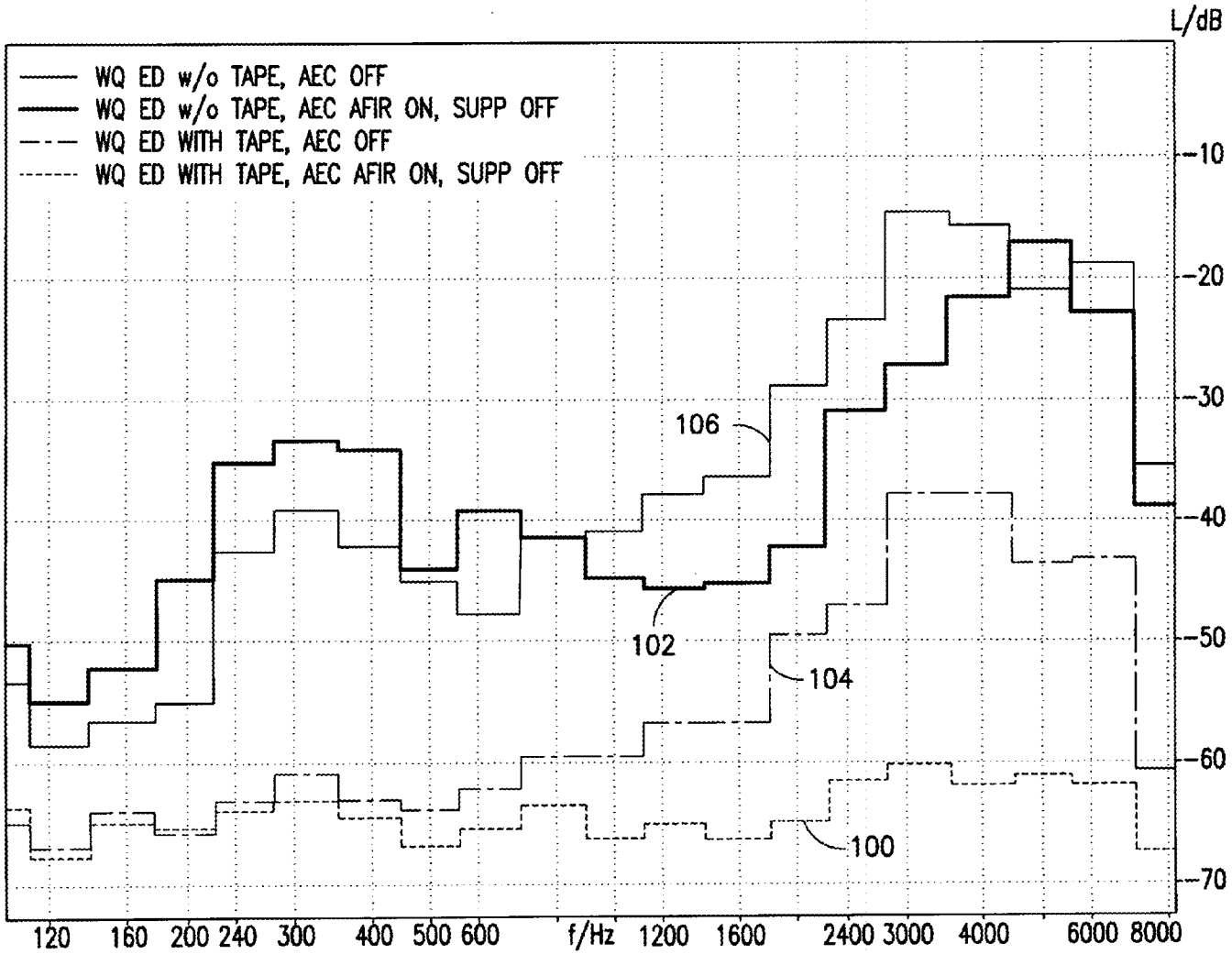
FIG. 9 is a chart illustrating performance increase.

FIG. 9 is an example chart illustrating Acoustic Echo Controller (AEC) adaptive filter performance with Adaptive Finite Impulse Response (AFIR). Adaptive finite impulse response (AFIR) filters are widely used for echo cancellation in long distance telephone circuits. 100 is for the apparatus 10 with the vibration dampener 42 and the AEC AFIR-ON. 102 is for the apparatus 10 with the vibration dampener 42 and the AEC AFIR-OFF. 104 is for the apparatus 10 without the vibration dampener 42 and the AEC AFIR-ON. 106 is for the apparatus 10 without the vibration dampener 42 and the AEC AFIR-OFF. The Weighted Terminal Coupling Loss (TCLw) figure with AEC disabled 106 gives an initial ear to microphone hardware coupling level as a baseline. The TCLw figure with only AEC Adaptive Filter active 104, when compared to AEC disabled figure, gives an estimate of linear coupling level. AFIR only gives about 22 dB TCLw improvement without the vibration dampener 42. However, as seen with 100, with the vibration dampener 42 the TCLw improvement is about 37 dB.

Figure 11:
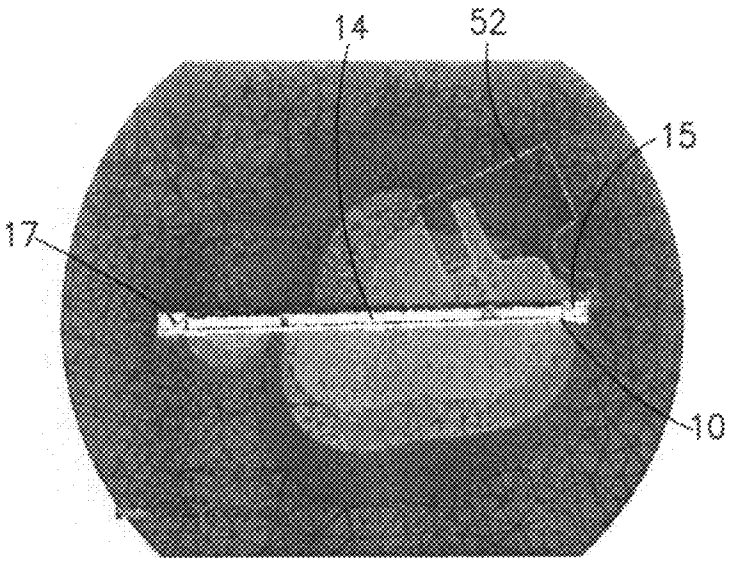
FIG. 11 is a diagram as in FIG. 10 with the vibration dampener.
Figure 10:
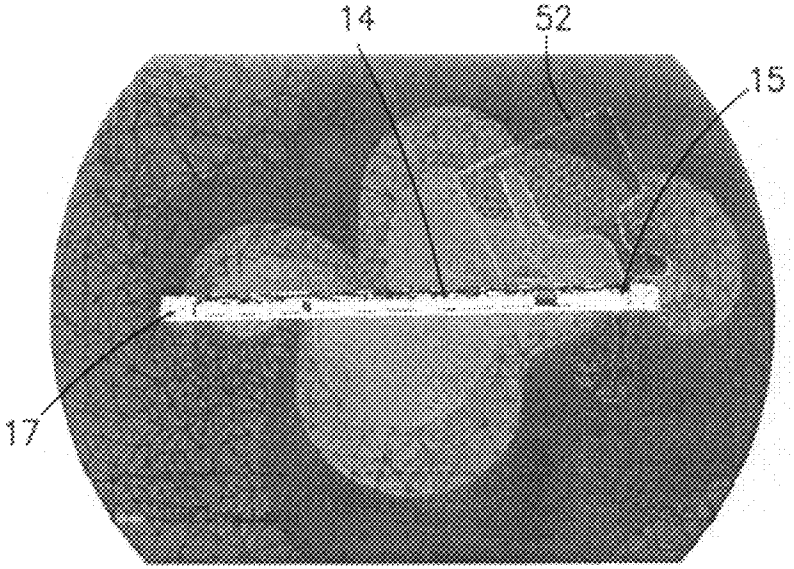
FIG. 10 is a diagram illustrating a simulated test without the vibration dampener.

Referring also to FIG. 10, a mock up has been simulated with an artificial head and torso simulator (HATS) (silicone ear 52) at the front side of the display 14 at the top end 15 with a pressure field at 500 Hz similar to the structure for FIG. 8 where the apparatus does not comprises the vibration dampener 42. Referring also to FIG. 11, the same mock up is shown, but with the vibration dampener 42. As can be seen by comparing FIG. 11 to FIG. 10, with the vibration dampener 42 the radiation is minimized in the lower area 17 near the main microphone 38. The sound aperture for the microphone may be drilled into the front glass. It is a much harder case for the echo cancellation software to deal with, in comparison to when the sound aperture and microphone is at the bottom end of the device. In the FEM simulation picture where is the front (display) side of the device. The echo tape may almost completely attach to half the front area.

Figure 13:
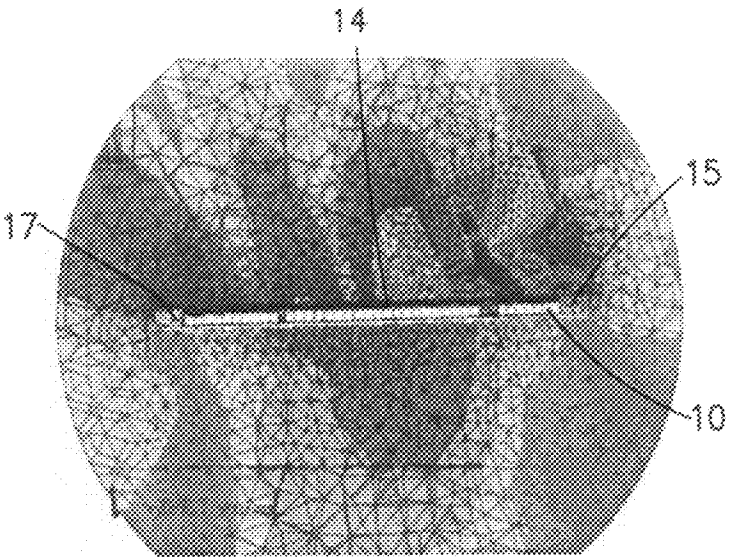
FIG. 13 is a diagram as in FIG. 12 with the vibration dampener.
Figure 12:
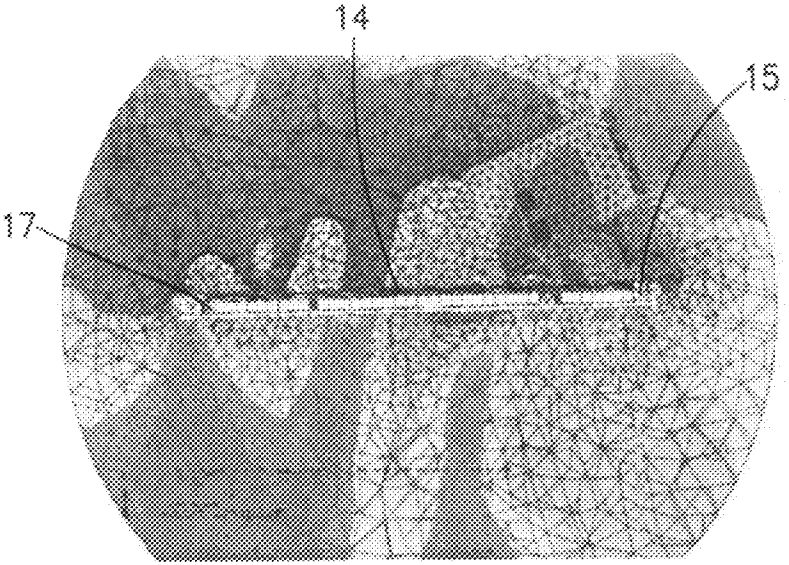
FIG. 12 is a diagram illustrating a simulated test without the vibration dampener.

Referring also to FIGS. 12 and 13, the mock ups of FIGS. 10 and 11, respectively, are shown at a pressure field at 6500 Hz. Again, as can be seen by comparing FIG. 12 to FIG. 13, with the vibration dampener 42 the radiation is minimized in the lower area 17 near the main microphone 38.

Figure 14:
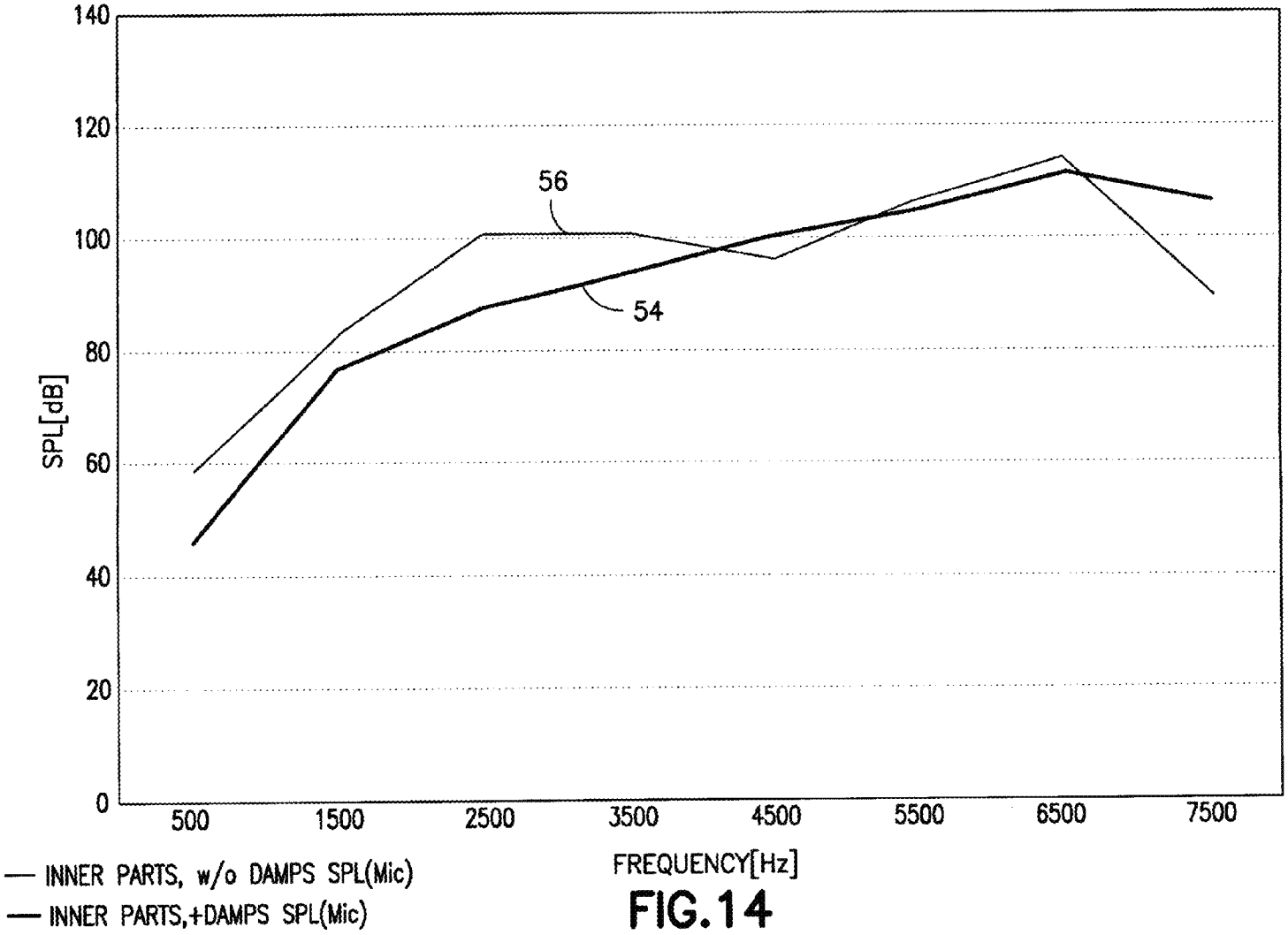
FIG. 14 is a chart illustrating sound pressure levels at the hole to the main microphone of the apparatus with and without the vibration dampener.

Referring also to FIG. 14, sound pressure levels at the hole to the main microphone 38 in the mock up jig are shown for the apparatus 10 with the vibration dampener 42 as illustrated by line 54 versus the apparatus without the vibration dampener 42 as illustrated by line 56.

An example embodiment may be provided in an apparatus comprising a frame; a speaker connected to the frame, where the speaker comprises at least one vibrating element and at least one display element, where the at least one vibrating element is configured to at least partially move the at least one display element to generate sound waves from the at least one display element; and at least one vibration dampening member between the frame and a rear side of the at least one display element, where the at least one vibration dampening member is located behind 10 percent or more of a lower half of the at least one vibration dampening member. The vibration dampening member form a vibration absorption member suitably positioned in a path between the movable member and the microphone (at least one sound capturing transducer). The path is defined where sound waves travel through the microphone by means of mechanical vibrations. A purpose is to eliminate/reduce vibrations which may otherwise be captured by the microphone in double talk situations. The sound is picked by the microphone in acoustic domain, but the sound would otherwise also travel using mechanical vibrations.

The at least one vibration dampening member may extend across a majority of a width of the at least one display element for 10 percent or more of the lower half of the at least one display element. The at least one vibration dampening member may be located against a majority of the lower half of the at least one display element at the rear side of the at least one display element. The at least one vibration dampening member may be attached to the rear side of the at least one display element by adhesive. The at least one vibration dampening member may comprise at least one of pressure sensitive adhesive (PSA) tape and firm foam. The at least one vibration dampening member might not extend substantially past the lower half of the at least one display element onto a top half of the at least one display element. A connection of the speaker to the frame may comprise a first section at a first location of the at least one display element and a second section at a second location of the at least one display element, where the first section comprises a soft suspension of the at least one display element between the at least one display element and the frame, where the second section comprises a harder suspension of the at least one display element between the at least one display element and the frame than the first section, and where the at least one vibrating element is located away from the second location of the at least one display element and located proximate the at least one display element at the first location of the at least one display element so as to move the at least one display element substantially using the first section based on the soft suspension of the at least one display element. The apparatus may further comprise at least one printed wiring board, where the display element is connected to a first one of the at least one printed wiring board; a processor connected to the at least one printed wiring board; a memory comprising software connected to the at least one printed wiring board; a camera connected to the at least one printed wiring board; and a battery connected to the at least one printed wiring board.

Figure 15:
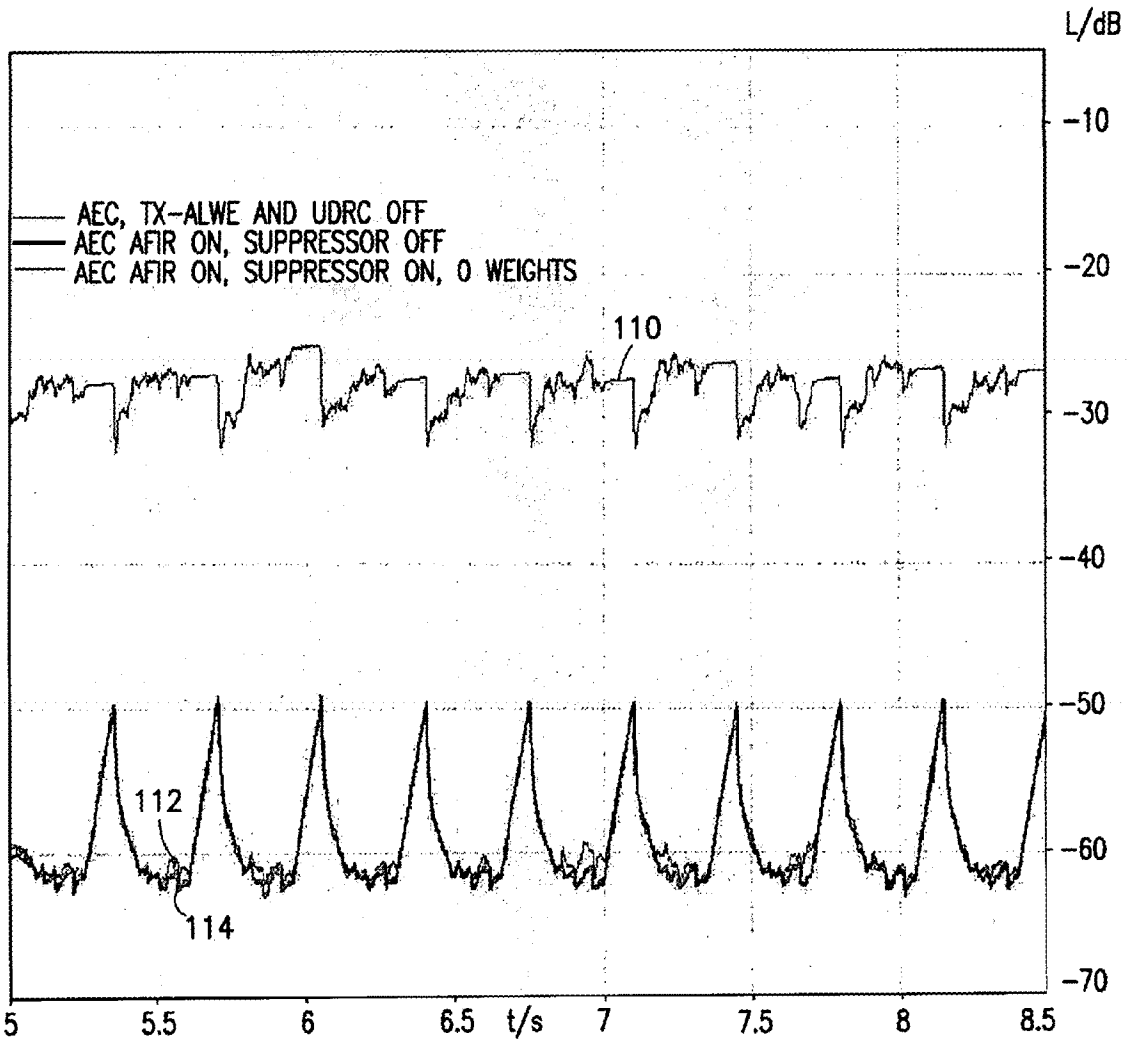
FIG. 15 is a chart illustrating an example of an echo level versus time with the tape vibration dampener.
Figure 16:
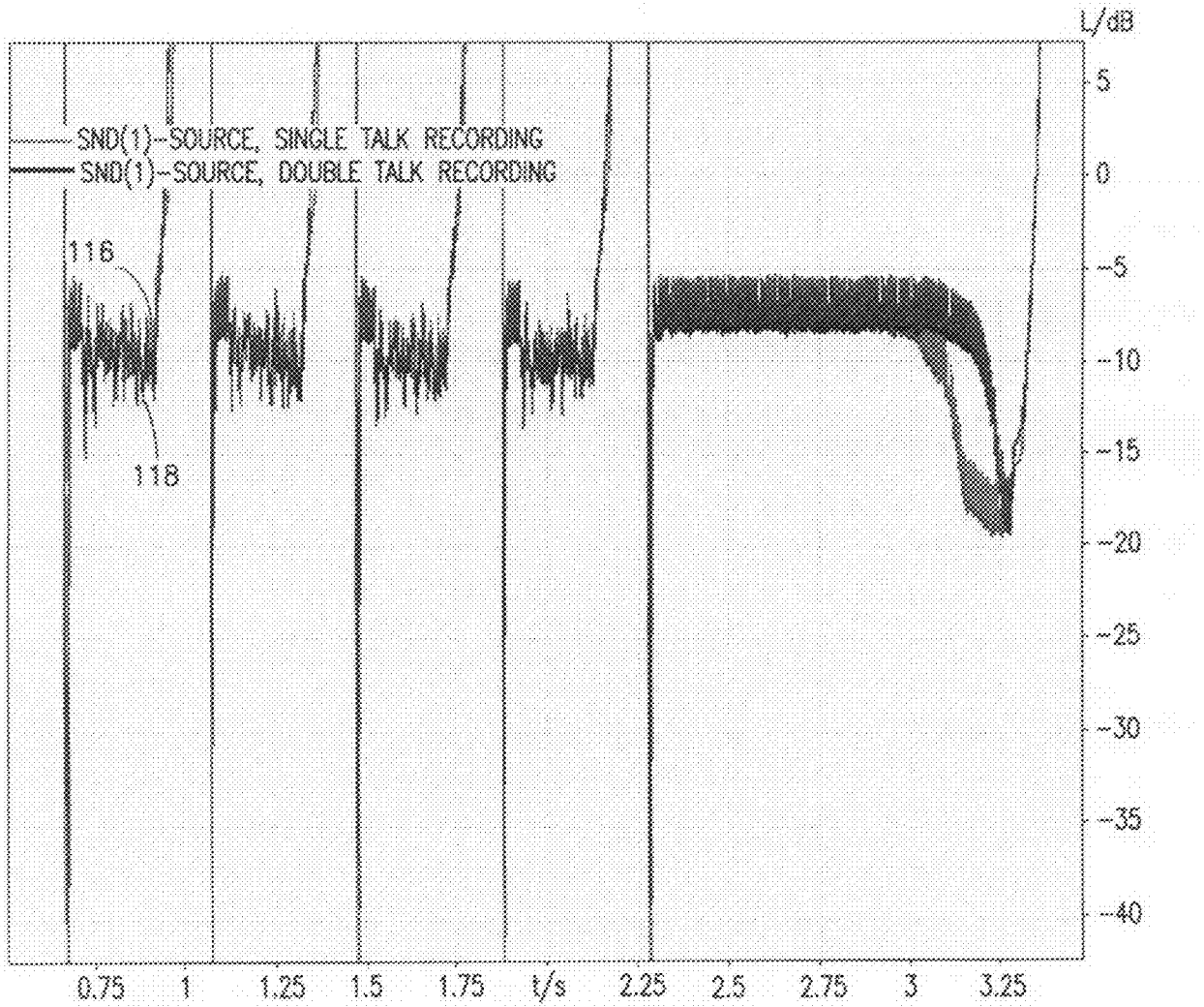
FIG. 16 is a chart illustrating an example of UL DT Att. with the tape vibration dampener.

Referring also to FIG. 15, a chart is shown illustrating an echo level versus time, at 16 dBm0, with the tape vibration dampener. Echo canceller performance is stable even when only the AEC Adaptive Filter is ON. Line 110 illustrates AEC, TX-ALWE and UDRC OFF. Line 112 illustrates AEC AFIR ON, supressor OFF. Line 114 illustrates AEC AFIR ON, suppressor ON, 0 weights. Referring also to FIG. 16, a chart is shown illustrating UL DT Att. with the tape vibration dampener. With Full-duplex operation, there is no UL double talk attenuation. For the two lines 116 (SND(1)—Source, Single Talk recording) and 118 (SND(1)—Source, Double Talk recording) the two lines are almost identical.

Figure 17:
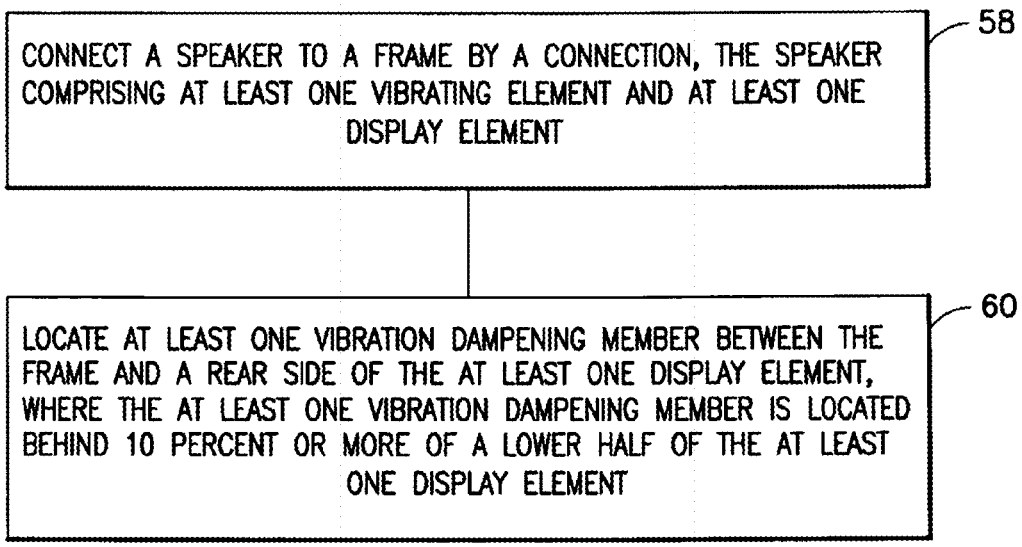
FIG. 17 is a diagram illustrating an example method.

Referring also to FIG. 17, an example method may comprise connecting a speaker to a frame by a connection, where the speaker comprises at least one vibrating element and at least one display element as indicated by block 58, where the at least one vibrating element is configured to at least partially move the at least one display element to generate sound waves from the at least one display element; and locating at least one vibration dampening member between the frame and a rear side of the at least one display element as indicated by block 60, where the at least one vibration dampening member is located behind 10 percent or more of a lower half of the at least one display element.

The at least one vibration dampening member may be located across a majority of a width of the at least one display element for 10 percent or more of the lower half of the at least one display element. The at least one vibration dampening member may be located against a majority of the lower half of the at least one display element at the rear side of the at least one display element. The at least one vibration dampening member may be attached to the rear side of the at least one display element by adhesive. The at least one vibration dampening member may comprise at least one of pressure sensitive adhesive (PSA) tape and firm foam. The at least one vibration dampening member might not extend substantially past the lower half of the at least one display element onto a top half of the at least one display element. The method may further comprise the speaker being connected to the frame by a connection comprising a first section at a first location of the at least one display element and a second section at a second location of the at least one display element, where the first section comprises a soft suspension of the at least one display element between the at least one display element and the frame, where the second section comprises a harder suspension of the at least one display element between the at least one display element and the frame than the first section, and where the at least one vibrating element is located away from the second location of the at least one display element and located proximate the at least one display element at the first location of the at least one display element so as to move the at least one display element substantially using the first section based on the soft suspension of the at least one display element.

An example embodiment may be provided in an apparatus comprising a frame; a speaker connected to the frame, where the speaker comprises at least one vibrating element and at least one display element, where the at least one vibrating element is configured to at least partially move the at least one display element to generate sound waves from the at least one display element; and at least one vibration dampening member connected against a rear side of the at least one display element, where the at least one vibration dampening member is located against 10 percent or more of a lower half of the at least one vibration dampening member.

The at least one vibration dampening member may extend across a majority of a width of the at least one vibration dampening member for 10 percent or more of the lower half of the at least one vibration dampening member. The at least one vibration dampening member may be located against a majority of the lower half of the at least one display element at the rear side of the at least one display element. The at least one vibration dampening member may comprise at least one of pressure sensitive adhesive (PSA) tape and firm foam. The at least one vibration dampening member might not extend substantially past the lower half of the at least one display element onto a top half of the at least one display element.

Figure 18:
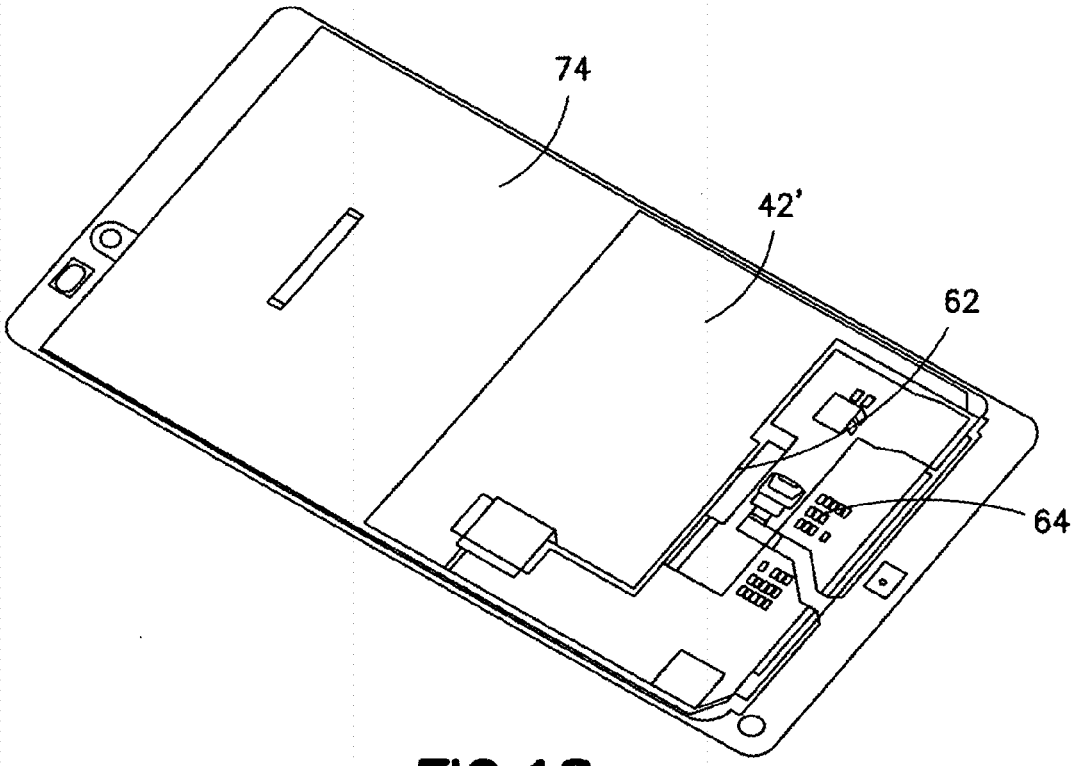
FIG. 18 is a perspective view showing an attachment of a vibration dampener to a display element.

Referring also of FIG. 18, a perspective view of another example embodiment is shown. In this example the vibration dampener 42' comprises PSA tape attached to the rear side of the display element 74. The bottom side 62 of the vibration dampener 42' has a cut-out shape such that the display and touch flex area 64 (area having a flex cable and electronics) is not connected with the tape 42' to the chassis/frame, and also may provide some clearance to the chassis for drop durability and tolerances. The tape 42' improves the echo situation and is located in the lower half of the display. In one example the tape 42' should be as big as possible in the lower half of the display element, but not tape onto members other than the rear side of the display element 74.

Figure 19:
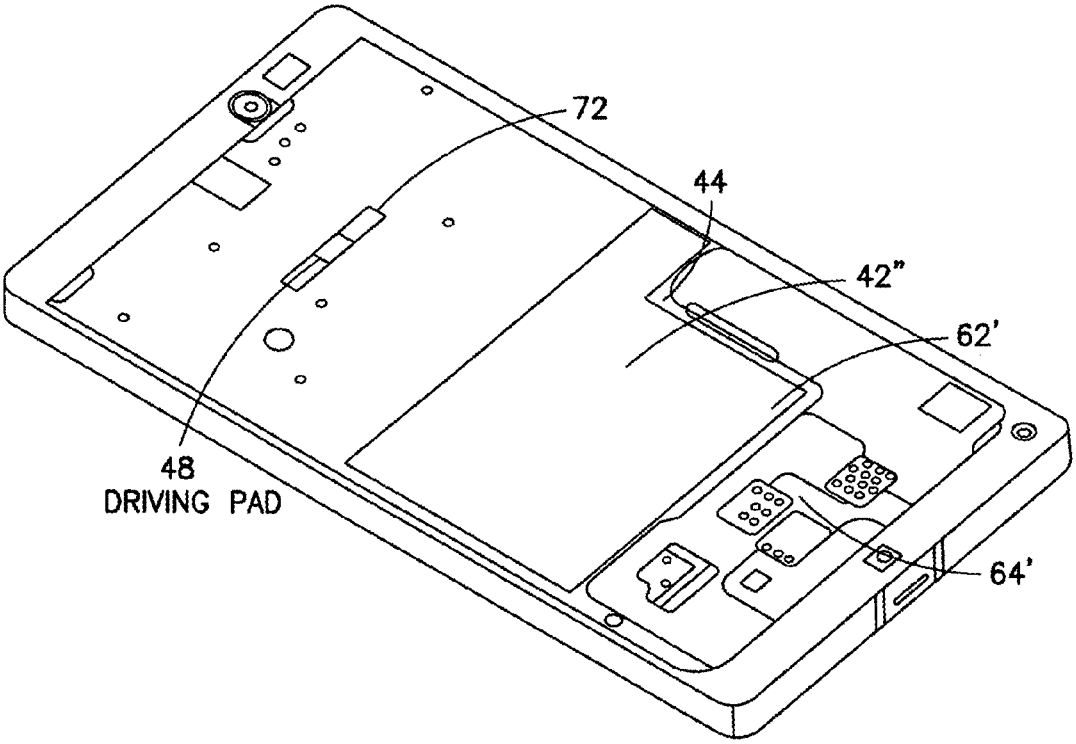
FIG. 19 is a perspective view showing an attachment of a vibration dampener to a portion of the frame/chassis.

Referring also to FIG. 19, a perspective view of another example embodiment is shown. In this example the vibration dampener 42" comprises PSA tape attached to the front side of the frame portion 44. The bottom side 62' of the vibration dampener 42" has a cut-out shape, such that it does not extend all the way to the bottom, such that the display and touch flex area 64' (area which receives the flex cable and electronics) is not connected with the tape 42" to the chassis/frame, and also may provide some clearance to chassis for drop durability and tolerances. The tape 42" improves the echo situation and is located in the lower half of the display. In one example the tape 42" should be as big as possible in the lower half of the display element, but not tape onto members other than the portion 44. The example shown in FIG. 18 could be used with the example shown in FIG. 19 where the vibration dampener comprises the two members 64' and 64" stacked on top of each other when the two assemblies shown in FIGS. 18 and 19 are assembled together.

Figure 20:
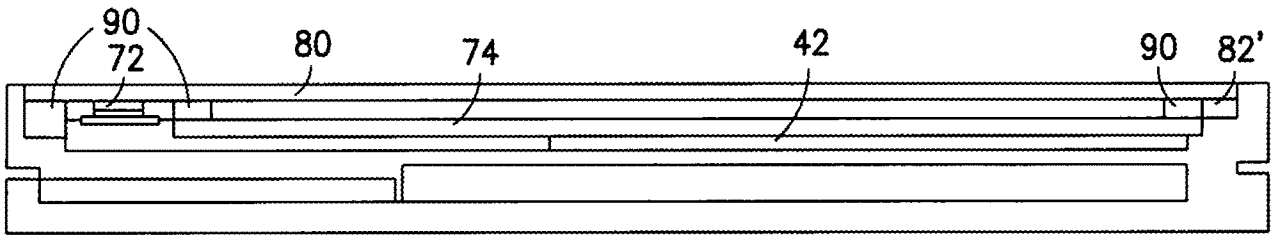
FIGS. 20-24 are schematic cross section views of alternate example embodiments.
Figure 21:
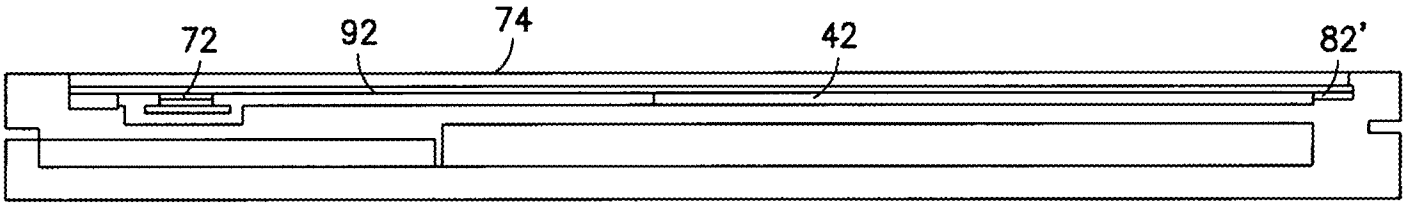
Figure 22:
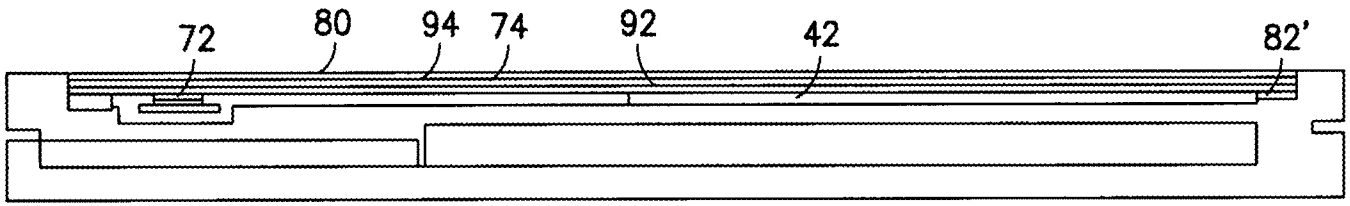
Figure 23:
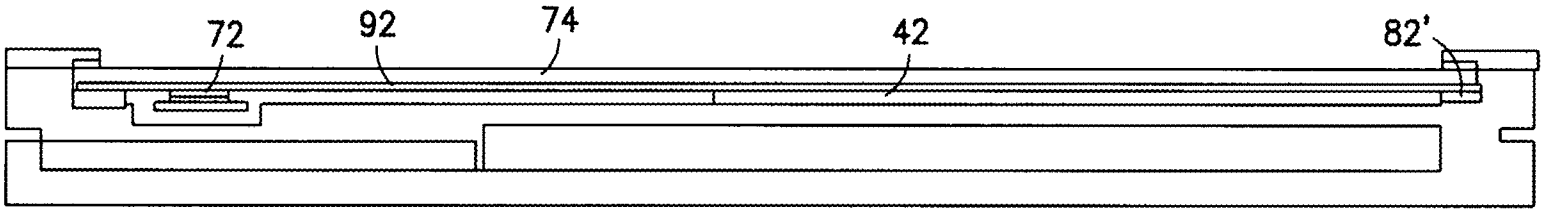
Figure 24:
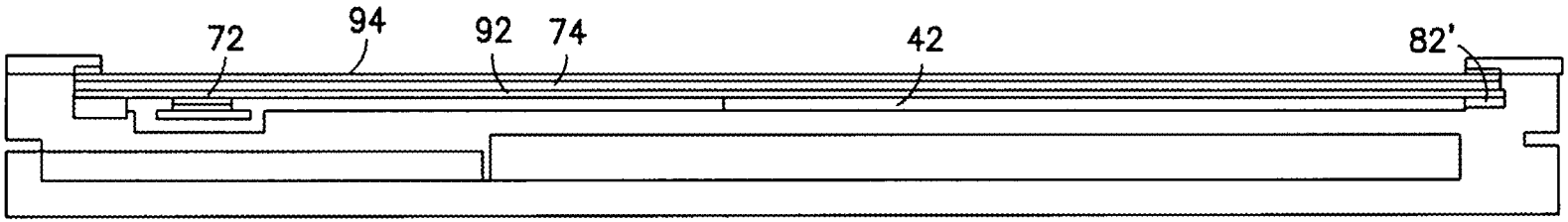

FIGS. 20-24 show various other different example embodiments. FIG. 20 shows an example embodiment similar to FIG. 5 but with one or more additional display gaskets 90. The front glass and display may not be laminated together. FIG. 21 shows an example embodiment similar to FIG. 5, but with an additional shield can and stiffening plate 92. FIG. 22 shows an example embodiment similar to FIG. 21, but with an additional front foil 94, such as a 50 μm-200 μm plastic sheet or glass foil for example. FIG. 23 shows an example without the front window 80. FIG. 24 shows another example without the front window 80.

Conventional mobile phones or smartphones all have some kind of echo cancellation algorithm which enable, during a phone call, both users to talk and listen at the same time. The devices are usually designed and tuned so that the acoustic signal that comes from a normal earpiece does not couple to the main microphone. The main microphone is supposed to transmit the voice of the user during a phone call. It can pick up some signals coming from the earpiece, such as if the main microphone is acoustically not sealed well for example. If that happens the user on the other side of the telephone line will experience some echo problems. The user that talks on the other end can hear the own voice.

In a mobile phone with an audio display, this issue can be even more difficult. It can be very challenging to prevent the main microphone from picking up a signal coming from the display panel speaker. The vibrations caused by the audio display may easily travel towards the main microphone and a large echo problem may occur on the other side of the telephone line. This issue is caused or amplified by the mechanical structure of such a device. In a normal device there is a sound outlet and it is usually far away from the main microphone. However, in audio display case, because the whole display is vibrating, and there are also the audible vibrations, these can be picked up by the microphone more easily. Features as described herein may be used to prevented this such that the microphone is better acoustically isolated.

Echo problems can be at least partially addressed by decreasing the loudness level of the sound source. Also, it can help if the sound source is de-coupled from the microphone as much as possible. This may be done by using dampening material such as foam gaskets, etc. Also, echo cancellation algorithms can be used so they can improve the performance.

With features as described herein, the sound source may be decoupled in an audio display device. One particular part, the vibration dampener 42, helps to increase the decoupling factor very well. In one type of example the device is constructed with a majority of parts made out of metal. The metal parts are stiffer; while some plastic covers tend to resonate more easily. Sound waves travel through metal parts quite easily compared to polymer materials. But in this particular case it is beneficial if metal is used due to its stiffness. The metal body gives the device a needed stiffness which is beneficial for the acoustic response (more flat, less dips and peaks). It is, of course, also better in terms of mechanical robustness (drop durability). Another beneficial thing is if the device has a glass based OLED display. The LCD display, due to its mechanical structure, may not provide so good frequency response; too many loose resonating parts. It is further beneficial that the OLED is behaving like a stiff panel made out of glass. It can be more easily fixed to the chassis body then a LCD display with many "loose" parts inside. Further, the device may have a metal chassis which is placed or separates the display from the back cover. A big portion of the chassis parts may work as a shield can for the display module. It shields the display form the PWB. It provides the whole phone structure some additional stiffness.

Initial audio measurements have shown that one could achieve a quite good frequency response with the above described construction. With the help of a laser vibrometer scanner, it was discovered that the panel vibration spreads towards the microphone. To calm down the behavior of the vibrating panel we have added, in the lower half of the display, the vibration dampener. In criteria such as TCLw, Spectral Echo Attenuation, Spectral Echo Attenuation, Echo Level vs. Time, Attenuation range—Double Talk the device with the added vibration dampener 42 shows better results than without. The FEM simulation of a simplified mock up described above with sound field images at 500 Hz and 6500 Hz to see the differences, this tapes 42 approach works very well. At least the middle chassis made out of metal is something, if implemented in the right way, seems to help the whole echo performance.

With a metal, middle chassis and the added tape 42 a device with a panel speaker has acceptable echo performance. The feature of using tape is very cheap. Tape added under the display also helps with drop test robustness.

An example embodiment may comprise a microphone; a speaker comprising at least one vibrating element and at least one movable section, where the at least one vibrating element is configured to at least partially move the at least one movable section to generate sound waves from the at least one movable section; and at least one vibration dampening member between the microphone and the at least one movable section, where the at least one vibration dampening member is suitably positioned in a path of vibration transmission between the at least one vibrating element and the microphone, where the at least one vibration dampening member is configured to absorb vibrations when the movable section is actuated by the at least one vibrating element. Implementations may include at least one piezo actuator which actuates either the display window or the display module or both. However, the invention is not restricted to an Audio Display. The movable section may comprise a portion of the frame in one example embodiment. Thus, in some embodiments it is possible that the piezo actuator may actuate a device cover rather than the display window or the display module. The frame can comprise a movable section or alternatively an apparatus cover can be actuated. The solution may be used to eliminate or reduce coupling where mechanical vibrations are picked up by the microphone of the same device where the piezo actuator actuates a module or section of the device. When such actuation occurs, the microphone can otherwise suffer from coupling especially in double talk situations i.e. a speech or video call.

An example method may comprise providing a speaker, where the speaker comprises at least one vibrating element and at least one movable section, where the at least one vibrating element is configured to at least partially move the at least one movable section to generate sound waves from the at least one movable section; and locating at least one vibration dampening member between the microphone and the at least one movable section, where the at least one vibration dampening member is suitably positioned in a path of vibration transmission between the at least one vibrating element and the microphone, where the at least one vibration dampening member is configured to absorb vibrations when the movable section is actuated by the at least one vibrating element.

An example embodiment may comprise a microphone; a speaker comprising at least one vibrating element and at least one movable section, where the at least one vibrating element is configured to at least partially move the at least one movable section to generate sound waves from the at least one movable section; and at least one vibration dampening member connected against the at least one movable section, where the at least one vibration dampening member is suitably positioned in a path of vibration transmission between the at least one vibrating element and the microphone, where the at least one vibration dampening member is configured to absorb vibrations when the movable section is actuated by the at least one vibrating element.

Features as described herein may be used to calm down the vibration of a normal device (non-panel speaker devices) such as a device with a conventional earpiece. The earpiece, if strong enough, can cause also that the display module starts to resonated. The vibrations may be caused by the proximity of the conventional earpiece to the glass and sometimes those earpieces are glued against the front window. The tape 42 could calm down the vibration of a display that has a hole inside for the earpiece outlet. The displays fixing design does not take that into account normally because the echo cancellation software can handle those low echo levels. If the echo tape 42 is fixed between a display and chassis in a device with a conventional earpiece, it could further improve the echo behavior.

The vibration dampening member may be used to eliminate coupling between a speaker and a microphone. The speaker may be formed by a section of a phone (apparatus) such as a display, a display window or a cover for example. These movable sections comprise larger surfaces than conventional speaker components. These sections may be suitably actuated by an actuator such as a piezo actuator for example. These sections are understood to be somehow mechanically coupled to the entire sections of the apparatus and, therefore, vibrations caused by the movable sections might otherwise be easily transmitted across other sections of the apparatus to reach the microphone(s). The problem occurs in double talk situations where both the microphone and the speaker are functional. Features as described herein help to stop vibrations from the speaker reaching the microphone in speech calls.

In example embodiments the PSA tape (or other similar vibration dampening or absorbing element) may be designed to improve the echo problem at a pre-determined frequency range. This range is not fixed across all products because there are different products which comprises different mechanical characteristics. Therefore, each device may exhibit such coupling effective in a particular frequency range, but such range may be different in another product. A design goal may be to eliminate such echo by designing a suitable vibration dampening element(s) in a particular location relative to a speaker movable section(s) and the microphone(s).

Features as described herein work with other types of speaker actuators as well as piezo actuators. Examples of an actuator include a piezo, a dynamic VC motor, an unbalanced armature, a balanced armature and a magnetostrictive driver. Piezos have many forms such as a bender, a direct driving ceramic or a disc for example. All piezos have great force, and some of those have such small movement that it has to be amplified somehow. The unlinear nature of piezos is a disadvantage, but the whole construction matters, and actuator is only one part. With a bender construction movement is amplified, it provides thin construction, and it is easy to adjust between force/deflection. With a direct driving ceramic, lots of force is typical, and they have very small movement. With discs, they are very inexpensive, but sound quality might not be greatest.

A dynamic VC motor provides good sound quality, it is tricky to make one with high force and small physical dimensions, and mechanical construction could be challenging because tolerance variation could cause distortion. With an unbalanced armature reasonable size can be achieved; roughly same volume as a basic construction in present phone Earpieces, and suites well to drive stiff glass. A balanced armature may be very challenging tolerance-wise. Typically, special means are used to make such components, such as handmade tuning droplet. A magnetostrictive driver provides high force and, in that sense, is good for this application (driving stiff glass). An air driver can also be located under display top end area. Air may then drive the window. An air driver itself could be, for example, a dynamic speaker.

The shape of the vibration dampening member (such as the foam pad/tape described above for example) may be important in regard to the dampening characteristics for example. For example, the edge of the dampening member facing towards the piezo actuator may be designed by gradually changing the shape for dampening (reducing received vibrations caused by the piezo). The edge of the dampening member facing towards the piezo actuator may have a saw-tooth shape for example. The saw-tooth shape may be uniform or non-uniform. The edge may have one or more sections with a regular or irregular or non-regular pattern. The shape of the edge may be designed based upon the amount of required dampening. The shape of the edge facing towards the piezo actuator may be non-uniform and/or non-straight. This non-uniform and/or non-straight shaping may be applied to one or more edges of the foam pad/tape.

The vibration dampening member may be located in a lower half of a movable section but, more significantly, the vibration dampening member may be located proximate to the handset microphone, such as in the lower half of the product for example.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. An apparatus comprising:

a microphone;

a speaker comprising at least one vibrating element and at least one movable section, wherein the at least one movable section is at least one section of the apparatus and at least in part covers the apparatus, where the at least one vibrating element is configured to at least partially move the at least one movable section to generate sound waves from the at least one movable section; and at least one vibration dampening member between the microphone and the at least one movable section, where the at least one vibration dampening member is suitably positioned in a path of vibration transmission between the at least one vibrating element and the microphone, where the at least one vibration dampening member is configured to absorb vibrations when the movable section is actuated by the at least one vibrating element;

wherein a connection of the speaker to a frame of the apparatus comprises a first section at a first location of the at least one movable section and a second section at a second location of the at least one movable section, wherein the first section comprises a soft suspension, wherein the second section comprises a harder suspension than the first section, wherein the at least one vibrating element is located away from the second location of the at least one movable section, and wherein the apparatus is an electronic device.

2. An apparatus as in claim 1 where the at least one vibration dampening member extends across a majority of a width of the at least one movable section for 10 percent or more of a lower half of the at least one movable section.

3. An apparatus as in claim 1 where the at least one vibration dampening member is located substantially in a lower half of the apparatus so as to substantially absorb vibrations before the vibrations reach the microphone.

4. An apparatus as in claim 1 where the at least one movable section comprises at least one of: at least one display element; a display; a display window and an apparatus cover, and where the at least one vibration dampening member is coupled to a rear side of the at least one movable section.

5. An apparatus as in claim 1 where the at least one movable section comprises at least one display element, and where the at least one vibration dampening member comprises at least one of pressure sensitive adhesive (PSA) tape and foam.

6. An apparatus as in claim 1 where the at least one movable section comprises at least one display element, and where the at least one vibration dampening member is located at a lower half of the at least one display element, where the at least one vibration dampening member comprises an edge having a non-straight and/or non-uniform shape.

7. An apparatus as in claim 1 where the first section comprising the soft suspension of the at least one movable section is between the at least one movable section and the frame, where the second section comprising the harder suspension of the at least one movable section is between the at least one movable section and the frame, and where the at least one vibrating element is located proximate the at least one movable section at the first location of the at least one movable section so as to move the at least one movable section substantially using the first section based on the soft suspension of the at least one display element.

8. An apparatus as in claim 1 further comprising:

at least one printed wiring board;

a processor connected to the at least one printed wiring board;

a memory comprising software connected to the at least one printed wiring board;

a camera connected to the at least one printed wiring board; and a battery connected to the at least one printed wiring board.

9. A method comprising:

providing a speaker, where the speaker comprises at least one vibrating element and at least one movable section, wherein the at least one movable section is at least one section of an apparatus and at least in part covers the apparatus, where the at least one vibrating element is configured to at least partially move the at least one movable section to generate sound waves from the at least one movable section; and locating at least one vibration dampening member between a microphone and the at least one movable section, where the at least one vibration dampening member is suitably positioned in a path of vibration transmission between the at least one vibrating element and the microphone, where the at least one vibration dampening member is configured to absorb vibrations when the movable section is actuated by the at least one vibrating element;

further comprising the speaker being connected to a frame by a connection comprising a first section at a first location of the at least one movable section and a second section at a second location of the at least one movable section, where the first section comprises a soft suspension, and where the second section comprises a harder suspension than the first section, and wherein the at least one vibrating element is located away from the second location of the at least one movable section, and wherein the apparatus is an electronic device.

10. A method as in claim 9 where the at least one movable section comprises at least one display element, and where the at least one vibration dampening member is located across a majority of a width of the at least one display element for 10 percent or more of a lower half of the at least one display element.

11. A method as in claim 9 where the at least one movable section comprises at least one display element, and where the at least one vibration dampening member is located against a majority of a lower half of the at least one display element.

12. A method as in claim 9 where the at least one movable section comprises at least one of: at least one display element; a display; a display window and an apparatus cover, and where the at least one vibration dampening member is coupled to a rear side of the at least one movable section.

13. A method as in claim 9 where the at least one vibration dampening member comprises at least one of pressure sensitive adhesive (PSA) tape and foam.

14. A method as in claim 9 where the at least one movable section comprises at least one display element, and where the at least one vibration dampening member is located at a lower half of the at least one display element, where the at least one vibration dampening member comprises an edge having a non-straight and/or non-uniform shape.

15. A method as in claim 9 where the at least one movable section comprises at least one display element, where the first section comprising the soft suspension of the at least one display element is between the at least one display element and the frame, where the second section comprising the harder suspension of the at least one display element is between the at least one display element and the frame, and where the at least one vibrating element is located proximate the at least one display element at the first location of the at least one display element so as to move the at least one display element substantially using the first section based on the soft suspension of the at least one display element.

16. An apparatus comprising:

a microphone;

a speaker comprising at least one vibrating element and at least one movable section, wherein the at least one movable section is at least one section of the apparatus and at least in part covers the apparatus, where the at least one vibrating element is configured to at least partially move the at least one movable section to generate sound waves from the at least one movable section; and at least one vibration dampening member connected against the at least one movable section, where the at least one vibration dampening member is suitably positioned in a path of vibration transmission between the at least one vibrating element and the microphone, where the at least one vibration dampening member is configured to absorb vibrations when the movable section is actuated by the at least one vibrating element;

wherein a connection of the speaker to a frame of the apparatus comprises a first section at a first location of the at least one movable section and a second section at a second location of the at least one movable section, wherein the first section comprises a soft suspension, wherein the second section comprises a harder suspension than the first section, wherein the at least one vibrating element is located away from the second location of the at least one movable section, and wherein the apparatus is an electronic device.

17. An apparatus as in claim 16 where the at least one movable section comprises at least one display element, and where the at least one vibration dampening member extends across a majority of a width of the at least one display element for 10 percent or more of a lower half of the at least one display element.

18. An apparatus as in claim 16 where the at least one movable section comprises at least one display element, and where the at least one vibration dampening member is located against a majority of a lower half of the at least one display element.

19. An apparatus as in claim 16 where the at least one vibration dampening member comprises at least one of pressure sensitive adhesive (PSA) tape and foam.

20. An apparatus as in claim 16 where the at least one movable section comprises at least one display element, and where the at least one vibration dampening member is located at a lower half of the at least one display element, where the at least one vibration dampening member comprises an edge with a non-straight and/or non-uniform shape.

21. An apparatus as in claim 1 where the at least one movable section comprises at least one display element, and where the at least one vibration dampening member comprises pressure sensitive adhesive (PSA) tape.

22. An apparatus comprising:

a speaker comprising at least one vibrating element and at least one movable section, wherein the at least one movable section is at least one section of the apparatus and at least in part covers the apparatus, where the at least one vibrating element is configured to at least partially move the at least one movable section to generate sound waves from the at least one movable section; and at least one vibration dampening member connected proximate the at least one movable section, where the at least one vibration dampening member is suitably positioned in a path of vibration transmission, where the at least one vibration dampening member is configured to absorb vibrations when the movable section is actuated by the at least one vibrating element;

wherein a connection of the speaker to a frame of the apparatus comprises a first section at a first location of the at least one movable section and a second section at a second location of the at least one movable section, wherein the first section comprises a soft suspension, wherein the second section comprises a harder suspension than the first section, wherein the at least one vibrating element is located away from the second location of the at least one movable section, and wherein the apparatus is an electronic device.

23. An apparatus as in claim 22 further comprising a gasket connected to the speaker, wherein the at least one vibrating element is between the gasket and the connection.

24. An apparatus as in claim 22 further comprising a stiffening plate between the at least one vibrating element and the at least one movable section.

25. An apparatus as in claim 22 wherein the at least one movable section comprises a display element, and wherein the display element is between a front foil and the at least one vibrating element.

26. An apparatus as in claim 22 wherein the at least one movable section comprises a display element without a front window.

* * * * *